US006439365B1

(12) United States Patent
Kubota

(10) Patent No.: US 6,439,365 B1
(45) Date of Patent: Aug. 27, 2002

(54) HIGH-SPEED CONTINUOUS CONVEYING SYSTEM

(76) Inventor: Masao Kubota, 22-7, Narimasu 2-chome, Itabashi-ku, Tokyo, 175-0094 (JP)

( * ) Notice: Subject to any disclaimer, the term of this patent is extended or adjusted under 35 U.S.C. 154(b) by 0 days.

(21) Appl. No.: 09/375,368

(22) Filed: Aug. 17, 1999

(30) Foreign Application Priority Data

Aug. 18, 1998 (JP) ..... 10-267182

(51) Int. Cl.[7] ..... B65B 21/00
(52) U.S. Cl. ..... 198/324
(58) Field of Search ..... 198/324, 321, 198/323, 837

(56) References Cited

U.S. PATENT DOCUMENTS

| | | | | |
|---|---|---|---|---|
| 2,936,873 A | * | 5/1960 | Seidman | |
| 3,150,757 A | * | 9/1964 | Minejiro Jin | |
| 3,698,535 A | * | 10/1972 | Johnson | 198/16 |
| 5,234,095 A | * | 8/1993 | Patin | 198/324 |
| 5,470,293 A | * | 11/1995 | Schonenberger | 198/834 |
| 5,765,679 A | * | 6/1998 | Greive | 198/834 |
| 5,950,797 A | * | 9/1999 | Aulanko et al. | 198/330 |
| 5,971,129 A | * | 10/1999 | Stawniak et al. | 198/325 |
| 6,068,107 A | * | 5/2000 | Brun-jarret | 198/324 |

FOREIGN PATENT DOCUMENTS

| | | | |
|---|---|---|---|
| EP | 685421 A1 * | 6/1995 | B66B/21/00 |
| JP | 3-186590 | 8/1991 | |
| JP | 5-31814 | 4/1993 | |
| JP | 5-63713 | 8/1993 | |
| JP | 07172747 A | 7/1995 | |

OTHER PUBLICATIONS

Loder Transport Systems Pty. Ltd., brochure entitled "The Loderway Accelerating Beltway. ", No Date.

* cited by examiner

*Primary Examiner*—Christopher P. Ellis
*Assistant Examiner*—Khoi H. Tran

(57) ABSTRACT

A high-speed continuous conveying system such as an escalator, a moving walk and a moving slope, in which a low-speed getting on/off section and a high-speed traveling section are connected in a transferring way. At least one movable slope unit using a toothed belt or a conveying roller chain is provided with inclination of a tread face gradually changing downwardly from a horizontal direction, so as to allow a passenger to transfer to a moving slope section provided at an end of a high-speed continuous conveying mechanism and inclined in the opposite direction. As the inclination angles of the slopes are set within the limited value, an angle between the slopes is within a range from 24° to 30°. Thus, a toothed-belt pulley or a chain pulley having an appropriate diameter can be used. In order to reduce a shock in transferring, speed Vn of the n-th tread is set to $\sqrt{n}$V1, where V1 is speed of the first transferring tread, so that an averaged acceleration is minimized in the transfer.

8 Claims, 5 Drawing Sheets

HIGH-SPEED CONTINUOUS CONVEYING SYSTEM

BACKGROUND OF THE INVENTION

1. Field of the Invention

The present invention relates to a conveying system for the purpose of increasing the speed of a continuous conveying apparatus, and contributes to efficient operation of a moving walk, a moving slope and an escalator.

2. Description of the Related Art

As an escalator or a moving walk travels at a low speed (normally 30 m/min) necessary for a passenger to get on/off, it has to travel at the low speed in its entire range, so that conveying efficiency is made relatively low. To solve this problem, there has been proposed a moving walk or the like which has a constitution such that a horizontal or inclined low-speed section using a small-diameter roller or a belt pulley is provided to allow a passenger to transfer to a horizontal high-speed running section of the moving walk or the like. However, this conveying apparatus has a problem in manufacture or lives of parts, so that it has many difficulties and its application is limited.

SUMMARY OF THE INVENTION

An object of the present invention is to secure a transition region sufficient in function and strength between a getting on/off area and a high-speed running element, and another object is to minimize shock and slip exerted on a passenger in transferring by setting optimum different speeds for tread faces, proposing components for forming the tread faces.

A limited angle of inclination for a moving slope depends on the material of a tread. A limited inclination angle for a surface of metal such as light metal and cast iron is standardized as 12°, and that for a surface of nonmetal such as hard rubber and plastics is standardized as 15°. Therefore, if a part of the running tread in the getting-on/off area, which is conventionally horizontal, is made sloping with an inclination angle within the limited value to allow the transfer between the treads having different speeds under a floor level, an angle between the sloping tread of a high-speed running member, which is a main traveling member, and a relatively low-speed sloping tread on the getting-on/off area becomes the sum of inclination angles of both slopes at the transferring area, so that a small belt pulley or a small chain pulley of appropriate size can be located. Further, there are provided a free running tread and a fixed bridge that enable smooth transfer in the getting-on/off area.

When the transfer is made between the treads with different speeds, a problem of shock arises for a passenger. The magnitude of shock is equal to a product of mass and acceleration of the passenger. Even if the mass is constant, the acceleration changes complicatedly. Considering an average acceleration, however, a criterion for the magnitude of shock can be obtained. As the actual method, it is considered that the shock is minimized if speeds of the respective treads are determined so that the average acceleration in each transfer are equal. In FIG. 1, when the tread face including the floor surface 0S is represented as nS (n=0, 1, 2, . . . , n, $\overline{n+1}$, . . . , N), a speed of the tread as Vn, an average acceleration when transfer is performed from nS to $\overline{n+1}$ S as An, a distance between transferring points as Ln, and time required for the transfer as Tn, an acceleration An in the transfer from the tread nS to the tread $\overline{n+1}$ S is expressed as follows;

$$An=(V\overline{n+1}-Vn)/Tn$$

$$Tn=Ln/[(V\overline{n+1}+Vn)/2]$$

$$An=(V\overline{n+1}^2-Vn^2)/2Ln$$

Therefore, $V\overline{n+1}^2-Vn^2=2AnLn$

If An and Ln are constant, $$V\overline{n+1}^2-Vn^2=\text{const.}$$

That is to say, $Vn^2$ (n=0, 1, 2, . . . ) forms an arithmetical progression, and since $$Vn^2=V0^2+n(VI^2\ V-V0^2)$$

$$V0=0$$

the following equation is obtained.

$$Vn=\sqrt{n}V1 \quad (1)$$

Equation (1) is a newly found important equation. If a speed train of the tread faces takes the values that substantially accord with this equation, a tread train with low shock is realized. As a numerical example, when V1=30 m/min and n=N=4, V4=60 m/min is obtained and a high speed twice a speed of an ordinary escalator or a moving walk is realized on the highest-speed running tread 4S. Further, it is useful to decrease V1 and increase N for aged persons, etc. For example, when V1=24.4949≈24.5 m/min, and N=6, V6=60 m/min is obtained but the speed changing area becomes long. When N is small, a passenger may transfer by striding over between the different-speed treads. However, when N is large, a free rotating roller may be interposed at an intermediate position of a bridge between the different-speed treads so that the transfer is performed easily and automatically. Such a system is shown in the embodiment. When V1=30 m/min and N=3 are set for simple constitution and easy transfer, V3=51.96≈52 m/min is obtained, which is useful for traveling of a short distance.

The following is a description of the operation of an escalator from a downstairs floor surface to an upstairs floor surface. The tread is provided with longitudinal grooves for safety, and the comb of the getting-on/off section and the both combs, front and rear, of the bridge fit in the grooves. As a passenger advances, he/she steps over the comb and bridge from the low-speed section to the medium-speed section, and the medium-speed section to the high-speed section along with his/her inertia, by which the transfer is made safely. Also, during the transfer from the high-speed moving slope section to the slope traveling with an inclination angle θ, the inclination of the tread is changed gradually to an allowable inclination angle, by which smooth traveling is made possible. However, in order that the slip and shock occurring when the passenger makes transfer by striding over the bridge between the different-speed treads do not impose an excessive burden on a passenger, a tread with a small speed difference is provided between the treads, and the sum of the longitudinal widths of the bridges before and behind the tread and the longitudinal width of the free tread is made approximately equal to the longitudinal length of shoe of the passenger, by which the slip and shock can be relieved. For example, when transfer begins at the getting-on area, the heel lies on the low-speed side, but the toe lies on the free moving side. Therefore, the free moving side is frictionally driven at the low speed. With further advance, the toe rides on the high-speed side, and the heel goes away from the low-speed tread and rides on the free tread. With still further advance, the heel transfers from the low-speed free tread to the high-speed side, by which the transfer is completed. If the above-described process is carried out relatively gradually, the slip and shock can be held within the allowable limit. When getting off the escalator, the passenger transfers from high speed to low speed. When the passenger advances from the state in which the heel still lies on the high-speed tread and the toe rides on the free tread, the heel goes away from the high-speed tread and rides on the free tread. With further advance, the heel also rides on the low-speed tread, by which the transfer is completed. If this process is carried out gradually, both of the slip and shock scarcely occur and are tolerable. As the aforementioned free tread, a free rotating roller is suitable for the reason of space.

DETAILED DESCRIPTION OF THE PREFERRED EMBODIMENTS

As a tread on the getting-on/off side, two materials are used: a metal such as iron and aluminum, and a macro molecular nonmetal such as hard rubber and plastics. For the reason of the coefficient of friction, the limited inclination angle of the former is standardized to be 12°, and the limited inclination angle of the latter is standardized to be 15°. Therefore, the tread having an inclination angle of 12° or smaller with respect to the horizontal getting-on/off section may be a metal surface, but the tread having an inclination angle larger than 12° and not larger than 15° must be a macro molecular nonmetal surface. Since the metal surface is advantageous in terms of maintenance, the tread having an inclination angle of 12° or smaller may be made of a metal, and a metal plate installed to an extending portion on one side of a link of a conveying roller chain is made a tread. The tread having an inclination angle from 12° to 15° uses a toothed belt made of macro molecular nonmetal or the aforementioned metal plate of the conveying roller chain which is coated with macro molecular nonmetal.

(1) A Case Where Two Toothed Belt Units are Used

Figure 1:
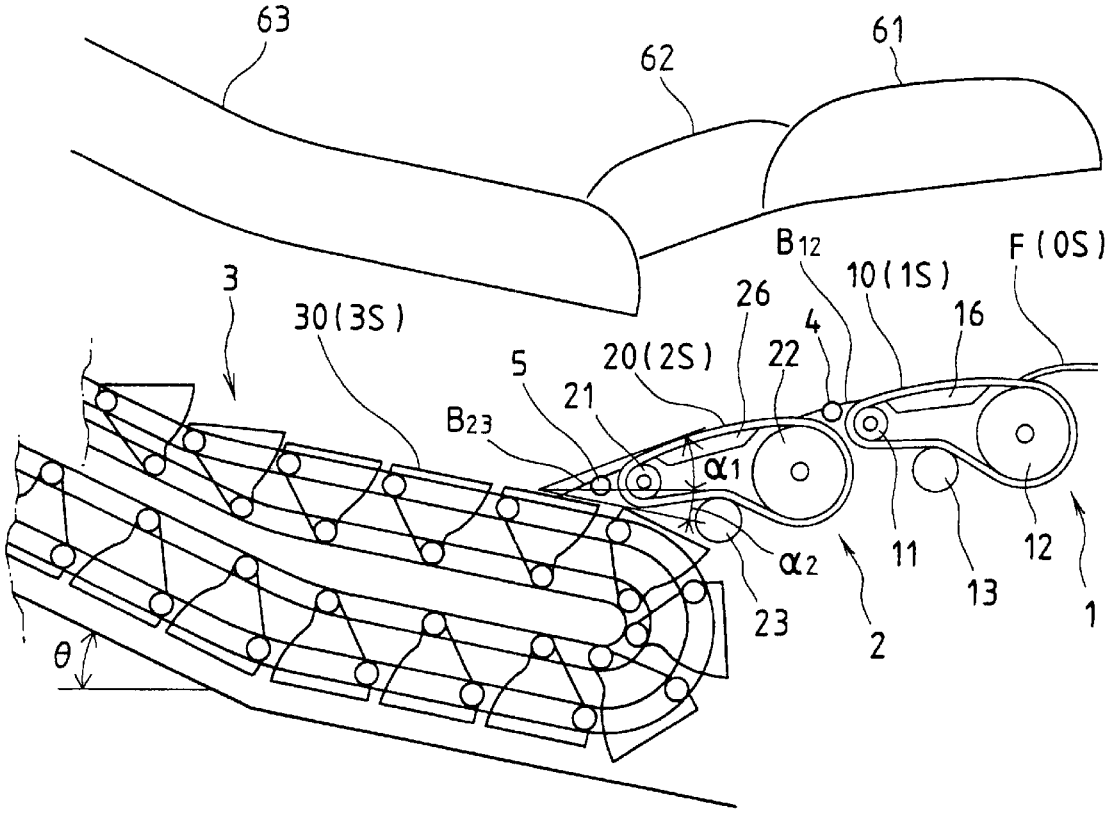
FIG. 1 is a side view showing a part of a high-speed continuous conveying system with a high-speed conveying mechanism of an escalator, in the vicinity of a downstairs floor getting-on/off region, using two toothed belt units at each getting-on/off region.

As shown in a side view of FIG. 1, a passenger transfers from a downstairs floor surface F to a slope tread face 30 of a high-speed running step train 3 through a slope tread face 10 of a low-speed toothed belt unit 1 and a slope tread face 20 of a medium-speed toothed belt unit 2. Each of the tread faces has a longitudinal grooves into which a comb fits. The belt units 1, 2 have a small belt pulley 11, 21, a large belt pulley 12, 22, and an idler wheel 13, 23, respectively. If a slope angel $\alpha 1$ is set to be a maximum angle of 15°, slope faces 10 and 20 are guided arcuately by guide members 16 and 26, respectively, and the slope angle is changed from 0° to 7.5° and from 7.5° to 15°, respectively. If the slope angle $\alpha 1$ of a medium-speed tread 20 is set to be the maximum value of 15° and the slope angle $\alpha 2$ of a high-speed tread 30 is set to be the maximum value of 12°, an acute angle between the treads 20 and 30 is 27°. Therefore, a space enough to contain a small belt pulley 21 located near a region of transfer from the tread 20 to the tread 30 can be secured. In order to decrease a coefficient of friction of a guide surface of the arcuate guide member 16, 26, it is preferable to take countermeasures such that the guide surface is quench polished, and the face of tooth is coated with PTFE (polytetrafluoroethylene resin), or an appropriate roller elements (not shown) are interposed.

Between the adjacent treads, bridges B12 and B23 each having comb teeth at both of front and rear ends, are provided to abut the tread. To reduce the friction with the back face of footwear of a passenger, free rotating rollers 4 and 5 (provided with circumferential grooves) may be provided. The free rotating rollers 4 and 5 project slightly through slits formed in the bridge surface, and come into contact with the footwear by means of rolling friction to receive the load of the passenger. To make transfer between the treads of different speed, the passenger may stride over or leave oneself to the movement of the tread utilizing the passenger's own inertia. To minimize the shock at this time, the tread speed should obey the equation (1). Taking the speeds of the slope treads 10, 20, and 30 as V1, V2, and V3, respectively, the relationship between the tread speeds should be $$V2=\sqrt{2}V1$$

$$V3=\sqrt{3}V1$$

For example, when V1=30 m/min, V2 and V3 are obtained as V2≈42.4 m/min and V3≈52.0 m/min. When the transfer is made from V2 to V3, since the direction of speed differs, the situation of shock differs and is complex. However, since the angles between the directions of running speed and the horizontal direction are 15° and 12°, the equation (1) is applied by approximately regarding that V2 cos $\alpha 1 \approx$ V2 and V3 cos $\alpha 2 \approx$ V3, and a correction is made experimentally, if necessary.

The moving handrails denoted by reference numerals 61, 62 and 63 are provided corresponding to the treads 10, 20 and 30, respectively. The large belt pulleys 12 and 22 can be driven by an ordinary transmitting mechanism, so that the illustration and description thereof are omitted.

Figure 2:
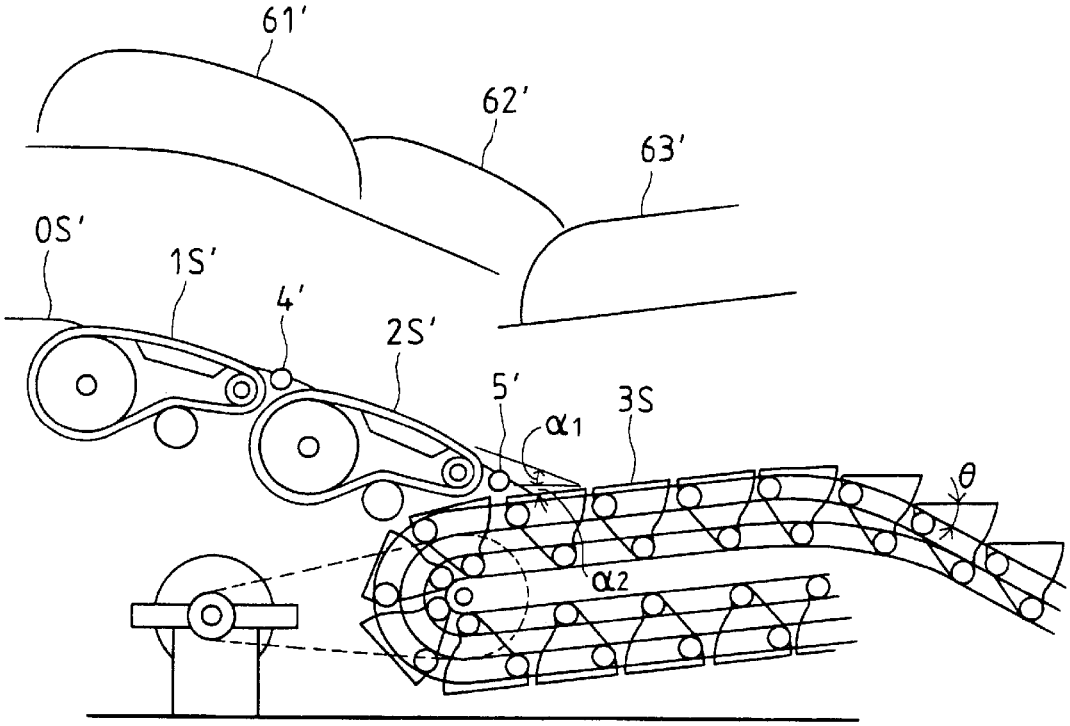
FIG. 2 is a side view of a part of the high-speed continuous conveying system shown in FIG. 1 in the vicinity of an upstairs floor getting-on/off region.

As shown in the side view of FIG. 2, the constitution near the upstairs floor getting-on/off portion is the same as that on the downstairs floor except that sequence of arrangement of components is reverse to that on the downstairs floor. Therefore, the corresponding element is denoted by adding a dash to the reference numeral of each element, and the description is omitted.

Figures 3A, 3B:
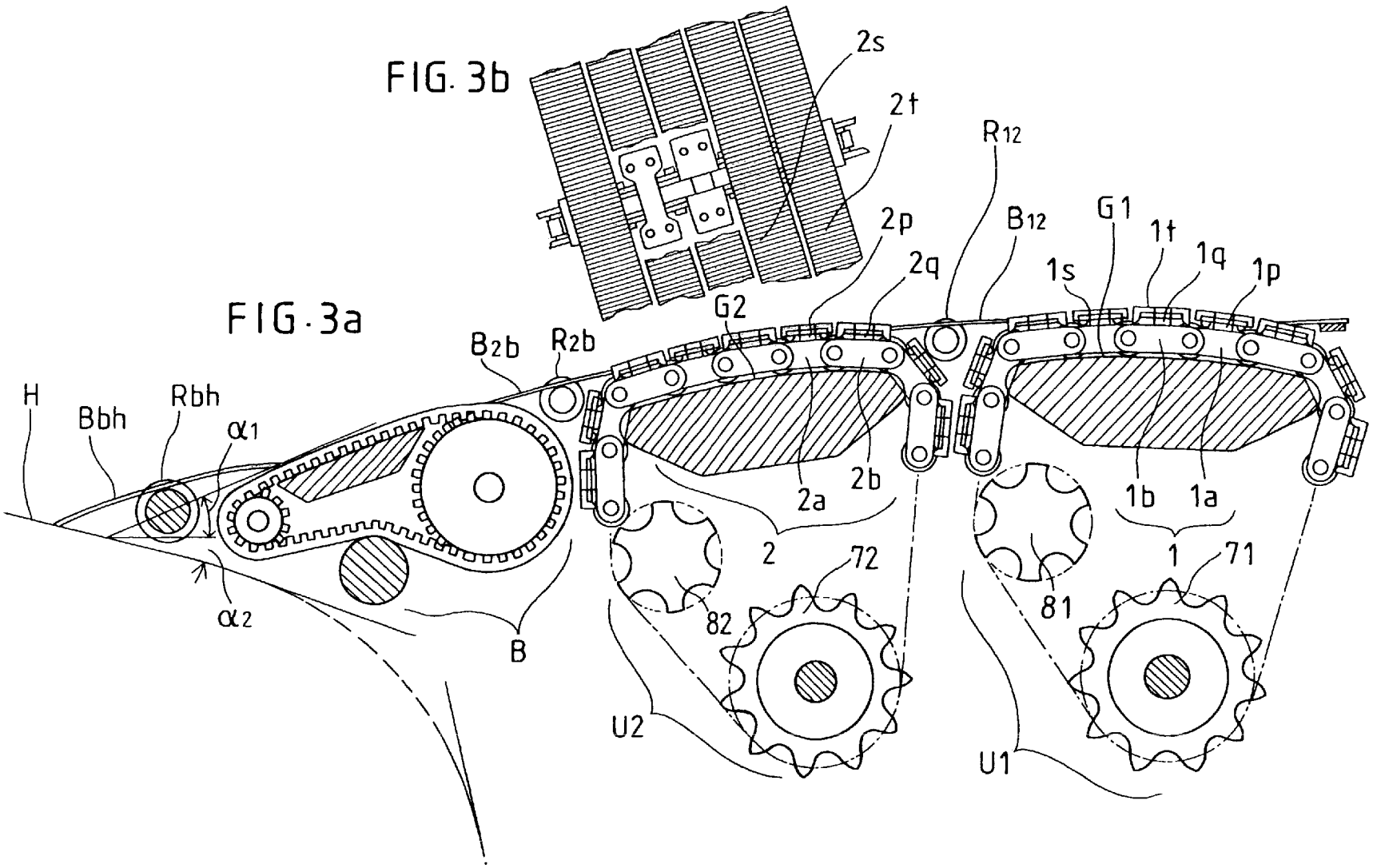
FIG. 3*a* is a side view of a part of a high-speed continuous conveying system in which roller chain units and a toothed belt unit are used in the vicinity of a downstairs floor getting on/off region.
FIG. 3*b* is a plan view on a plane substantially parallel to a tread of the unit.

(2) A Case of Adopting a Conveying Roller-chain Unit with Upper Plates:

A typical constitution of a conveying roller chain equipped with upper plates functioning as treads is shown in FIGS. 3*a* and 3*b*. An example shown in the drawings is a case where two roller chain units Un (n=1, 2) and one toothed belt unit B are combined to connect with a high-speed running slope tread H. A roller link na (n=1, 2) and a pin link nb of a roller chain are bent perpendicularly on one side and upper plates np, nq are placed individually thereon. Treads ns, nt each having longitudinal grooves are fixed to the upper plates np, nq, and rollers to be driven by a sprocket 7*n* are guided by an arcuate guide face Gn. Here, a mechanism having the above constitution is called a roller chain unit Un. The chain unit Un is provided with the driving sprocket 7*n* and an idler gear 8*n*. Between the roller chain units U1 and U2 are provided a bridge 12 and a free rotating roller R12 whose top portion projects through a central slit formed on the bridge B12. Between the roller chain unit U2 and the toothed belt unit B are provided a bridge B2*b* and a free rotating roller R2*b*. Between the toothed belt unit B and the high-speed running slope tread H are provided a bridge Bbh and a free rotating roller Rbh. Moving handrails are provided corresponding to the roller chain units U1 and U2, the toothed belt unit B. and the high-speed running slope tread H. The running speeds in the typical case are as given in the table below.

| V1 | V2 | V3 | V4 | V5 | V6 | |
|---|---|---|---|---|---|---|
| 30 | 42.4 | 52.0 | 60.0 | 67.1 | 73.5 | (m/min) |
| 24 | 33.9 | 41.6 | 48.0 | 53.7 | 58.8 | |

(3) Application to a Moving Walk

Figure 4:
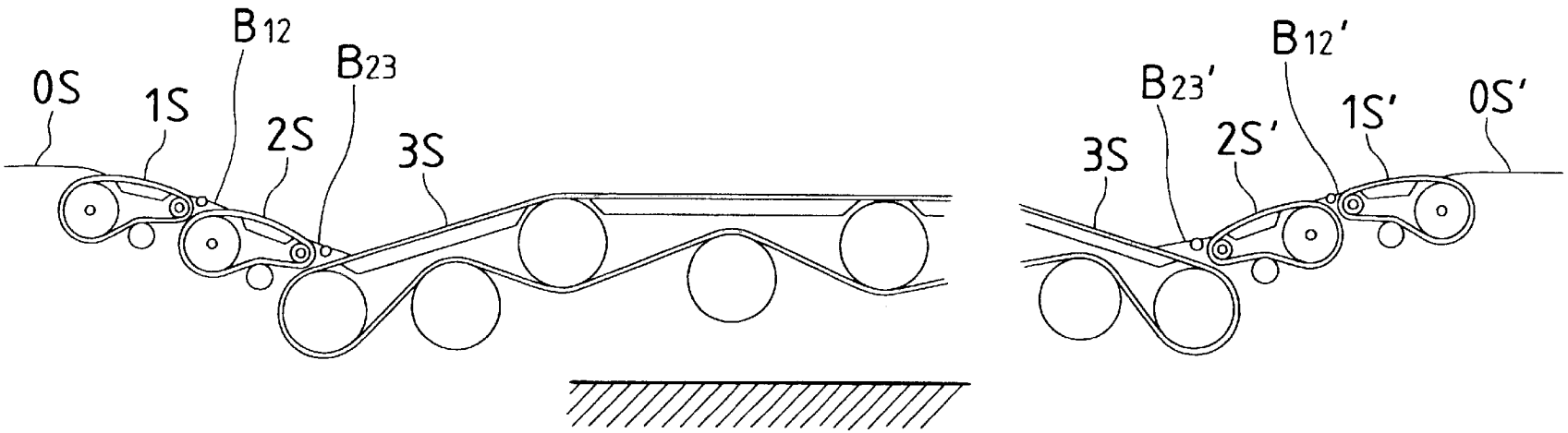
FIG. 4 is a side view of a high-speed continuous conveying system with a high-speed conveying mechanism of a moving walk, using two toothed-belt units at each getting-on/off region (moving handrail is omitted)

FIG. 4 shows an example in which the present invention is applied to a moving walk. Although toothed belt units are used in this example, roller chain units may be used. For simplicity, the moving handrails are omitted in the drawing. In FIG. 4, reference characters 0S and 0S' denote floor surfaces, 1S and 1S' denote low-speed getting-on/off treads, 2S and 2S' denote medium-speed treads, 3S and 3S' denote high-speed slope treads, B12, B12', B23 and B23' denote bridges with free rotating rollers.

(4) Single-unit Low-shock High-speed System

Figure 5:
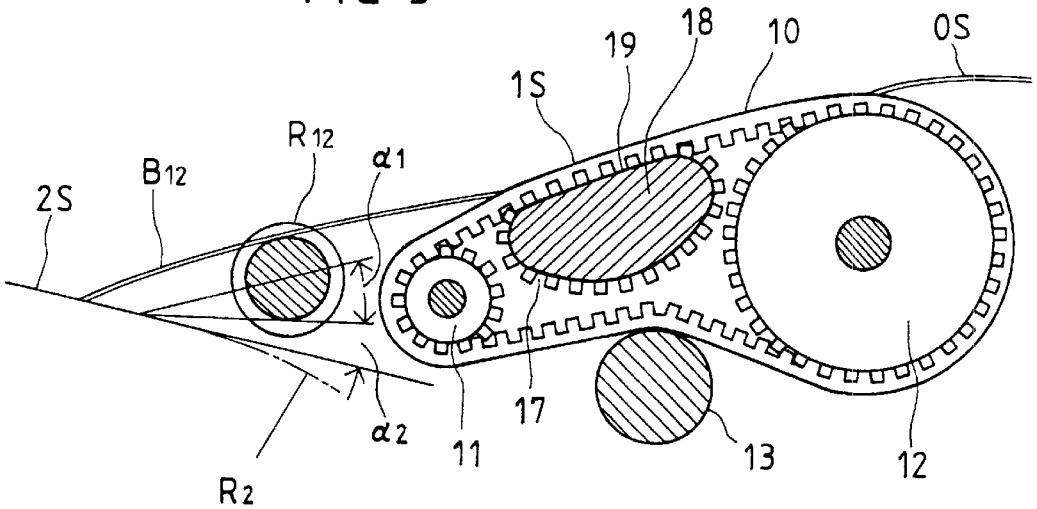
FIG. 5 is a side view of a high-speed continuous conveying system using only one belt unit at each getting-on/off region.
Figure 6B:
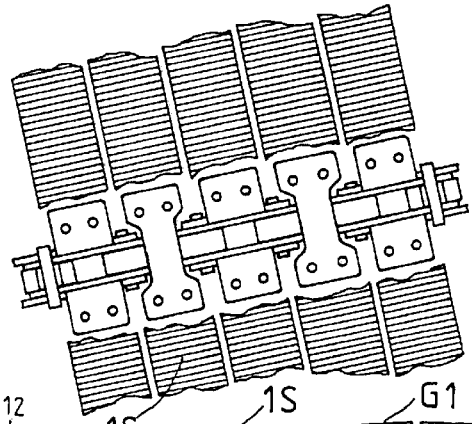
FIG. 6*b* is a plan view to a plane substantially parallel to a tread of the unit.
Figure 6A:
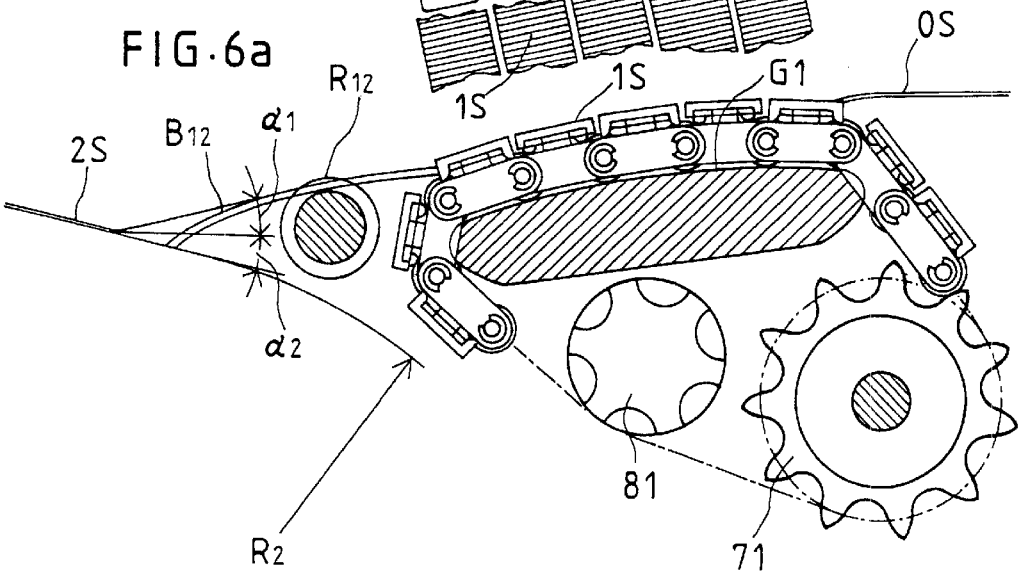
FIG. 6*a* is a side view of a high-speed continuous conveying system using only one roller-chain unit at each getting-on/off region.

To achieve high-speed running with low shock, a plurality of conveying units have to be used. However, an underfloor space is needed at the getting-on/off region. If it is difficult to secure the space, a single-unit system is preferably used. FIGS. 5, 6*a* and 6*b* show examples of the single-unit system. FIG. 5 shows an example in which a toothed belt unit is used, and FIGS. 6*a* and 6*b* show an example in which a roller chain unit is used. FIG. 6*a* is a side view of a conveying unit and the vicinity thereof, and FIG. 6*b* is a plan view substantially parallel to treads of the conveying unit. Reference numerals of the parts are the same as those used in FIGS. 1 and 3. However, in FIG. 5, as a guide member for supporting the conveying belt with the tread 10, a supporting toothed belt 17 engaged opposingly with the conveying belt and a support member 18 having a guide face 19 for guiding and supporting the supporting belt are used. The supporting belt 17 is wound and circulated around the support member 18 (the lower half thereof has an arcuate cross section). With this arrangement, a life of the conveying belt is elongated.

According to the present invention, a high-speed escalator, a moving walk, and a moving slope that is simple in structure with low shock in transferring can be realized.

What is claimed is:

1. A high-speed continuous conveying system comprising:

a high-speed conveying mechanism having moving slope sections at both ends thereof with a first inclination angle at least one of not greater than 12 degrees if a surface of the high-speed conveying mechanism is metal and not greater than 15 degrees if the surface is rubber or plastic; and moving slope mechanisms each interposed between said moving slope section of said high-speed conveying mechanism and a floor so as to continuously connect the floor with said moving slope section, and having a tread face inclined with a second inclination angle at least one of not greater than 12 degrees if a surface of the high-speed conveying mechanism is metal and not greater than 15 degrees if the surface is rubber or plastic, to thereby allow a passenger to transfer between the floor and said moving slope section through said moving slope mechanism.

2. A high-speed continuous conveying system according to claim 1, wherein said moving slope mechanism includes a toothed-belt conveying unit.

3. A high-speed continuous conveying system according to claim 1, wherein said moving slope mechanism includes a roller-chain conveying unit.

4. A high-speed continuous conveying system according to claim 1, wherein said high-speed conveying mechanism comprises an escalator having a plurality of tread faces.

5. A high-speed continuous conveying system according to claim 1, wherein said high-speed conveying mechanism comprises a moving walk having a single continuous tread face.

6. A high-speed continuous conveying system according to claim 1, wherein said moving slope mechanism comprises a conveying unit providing a tread face with a running speed lower than a running speed of said movable slope section of said high-speed conveying mechanism, a stationary bridge disposed between said conveying unit and said moving slope section, and a free running tread disposed in the middle of said stationary bridge.

7. A high-speed continuous conveying system according to claim 1, wherein said moving slope mechanism comprises a series of conveying units providing a plurality of tread faces each having a stepwise different running speed, stationary bridges disposed between said conveying units and between said conveying unit and said moving slope section, and a free running tread disposed in the middle of said stationary bridge.

8. A high-speed continuous conveying system comprising:

a high-speed conveying mechanism having a moving slope section at both ends; and a moving slope mechanism interposed between each of the moving slope sections of the high-speed conveying mechanism and a floor so as to continuously connect the floor with each of the moving slope sections, to thereby allow a passenger to transfer between the floor and the moving slope section, wherein the moving slope mechanism comprises a series of conveying units providing a plurality of tread faces each having a stepwise different running speed, and a running speed Vn of n-th tread face of said conveying units from the floor is determined substantially according to the following progression: $Vn=\sqrt{n}\ V1$ wherein V1 represents a running speed of a first tread face of the conveying units.

* * * * *

UNITED STATES PATENT AND TRADEMARK OFFICE

CERTIFICATE OF CORRECTION

PATENT NO. : 6,439,365 B1
DATED : August 27, 2002
INVENTOR(S) : Masao Kubota

It is certified that error appears in the above-identified patent and that said Letters Patent is hereby corrected as shown below:

Column 2,
Line 13, change "$(V1^2 -V-V0^2)$" to -- $(V1^2-V0^2)$ --

Column 5,
Line 25, change "B." to -- B, --.

Signed and Sealed this

Twenty-fifth Day of March, 2003

JAMES E. ROGAN
*Director of the United States Patent and Trademark Office*